US005143282A

United States Patent [19]

Pham

[11] Patent Number: 5,143,282

[45] Date of Patent: Sep. 1, 1992

[54] APPARATUS AND METHOD FOR MAINTAINING CLOSED HINGED LID BOXES

[75] Inventor: Xuan M. Pham, Richmond, Va.

[73] Assignee: Philip Morris Incorporated, New York, N.Y.

[21] Appl. No.: 573,884

[22] Filed: Aug. 28, 1990

[51] Int. Cl.[5] ..... B65D 43/16

[52] U.S. Cl. ..... 229/160.1; 229/148

[58] Field of Search ..... 229/160.1, 148, 182.1; 206/271, 273

[56] References Cited

U.S. PATENT DOCUMENTS

| | | | |
|---|---|---|---|
| 2,163,828 | 6/1939 | Chalmers . | |
| 2,387,392 | 10/1945 | Guyer et al. | 229/182.1 |
| 3,090,540 | 5/1963 | Arneson | 229/148 |
| 3,163,348 | 12/1964 | Schmermund . | |
| 4,114,777 | 9/1978 | Frohling et al. | 229/160.1 |
| 4,216,898 | 8/1980 | Davies | 229/160.1 |
| 4,251,022 | 2/1981 | Focke . | |
| 4,284,197 | 8/1981 | Meyers | 229/159 |
| 4,466,536 | 8/1984 | Zeitel . | |
| 4,753,383 | 6/1988 | Focke et al. . | |
| 4,753,384 | 6/1988 | Focke et al. . | |
| 4,852,734 | 8/1989 | Allen et al. . | |
| 4,948,038 | 8/1990 | Moeller . | |
| 4,955,531 | 9/1990 | Graboyes | 229/182.1 |

FOREIGN PATENT DOCUMENTS

| | | | |
|---|---|---|---|
| 654558 | 12/1962 | Canada . | |
| 1572897 | 8/1980 | United Kingdom | 206/268 |

*Primary Examiner*—Stephen Marcus
*Assistant Examiner*—Christopher McDonald

[57] ABSTRACT

A hinged lid box having an innerframe and rounded corners and means for maintaining the box substantially closed. The means includes a second front panel of material affixed in superposition to the interior front panel of the box lid to engage the innerframe of the box, providing increased structural support and frictional forces that retain the box in a closed position. The second panel of material has approximately the same width at the lid panel and a height that is greater than 50% and less than 100 % of the height of the box lid. The panel also may have tabs extending from the panel into the rounded corners of the box so that the tabs are interposed between the innerframe corners and the lid corners when the lid is closed.

23 Claims, 4 Drawing Sheets

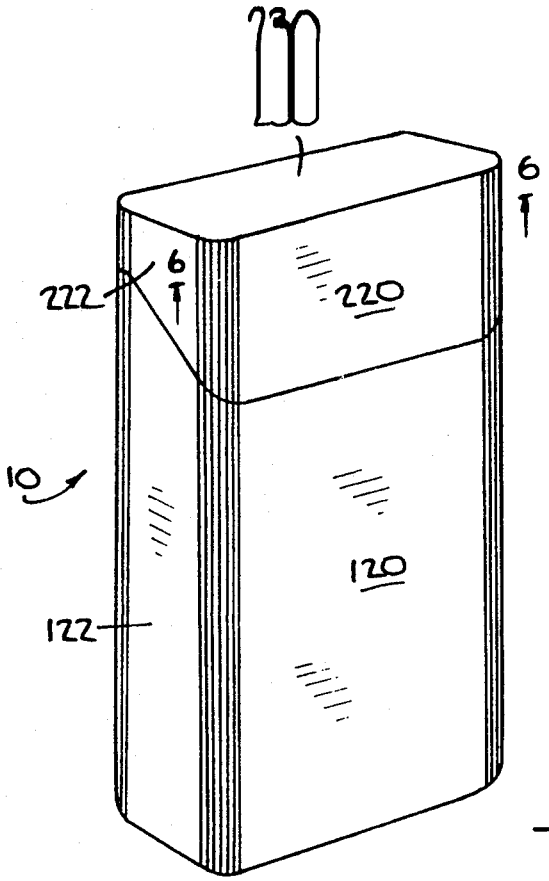
Fig. 1
Fig. 2
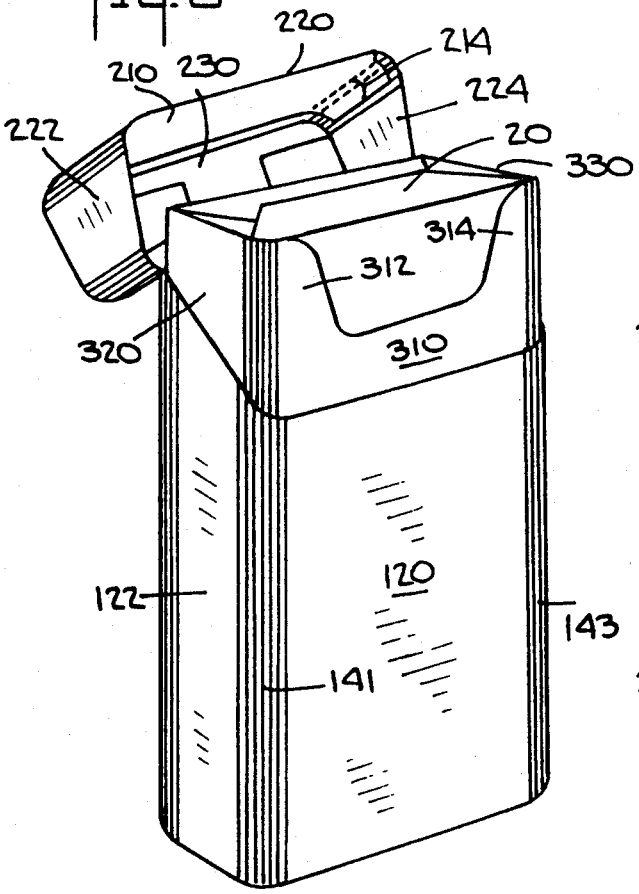
Fig. 3
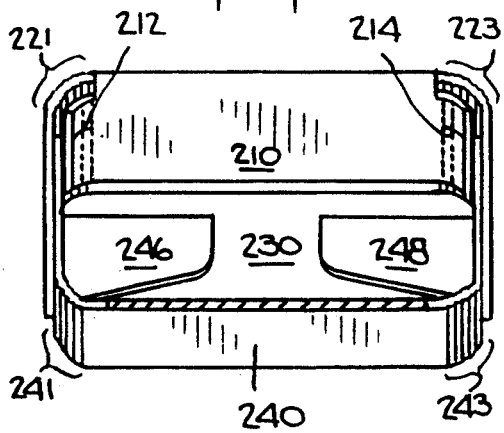

Fig. 5
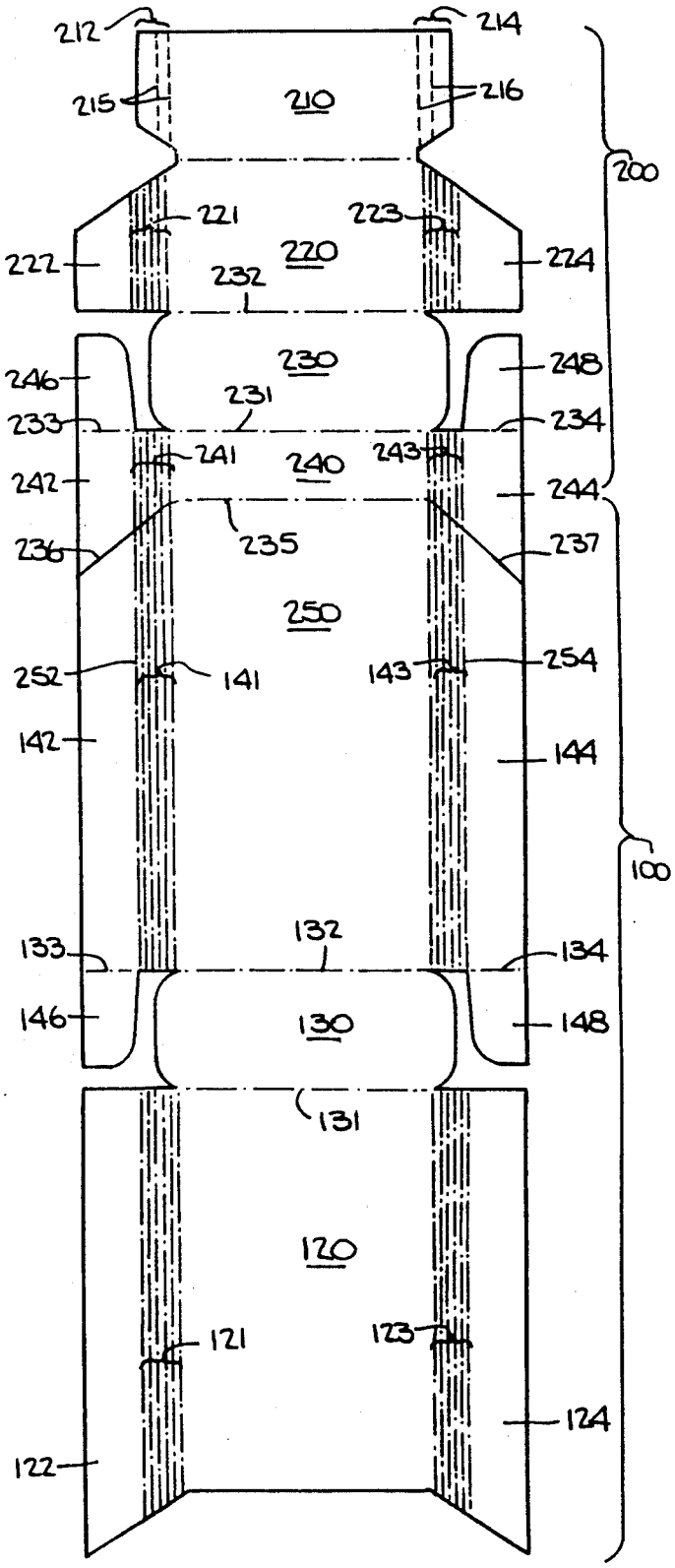
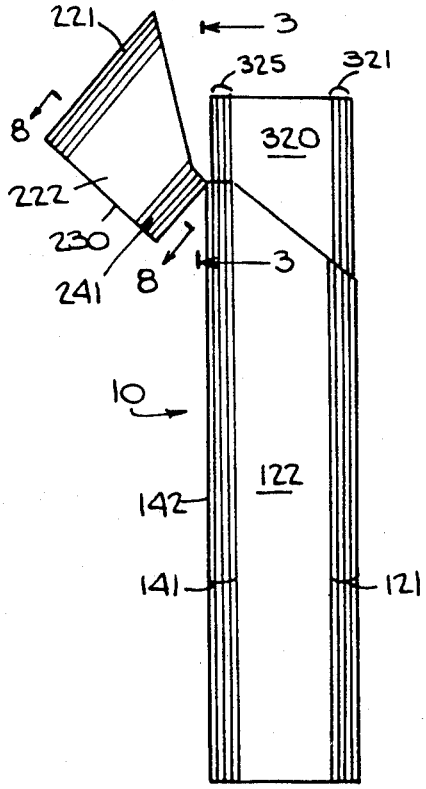
Fig. 4

APPARATUS AND METHOD FOR MAINTAINING CLOSED HINGED LID BOXES

BACKGROUND OF THE INVENTION

This invention relates to boxes having a hinge connecting the box lid to the box body, and particularly to maintaining closed the lid of a hinged lid box having rounded corners for containing smoking articles such as cigarettes.

One type of package in which cigarettes are sold is a hard paperboard box having a hinged lid. A hard paperboard innerframe is secured to the front of the box body and extends out the body. The cigarettes are bundled in a foil liner inside the box body and are at least partially surrounded by the innerframe. The box lid fits over the innerframe and the cigarettes. The innerframe provides a frictional engagement surface to retain the lid in the closed position and protects the cigarettes that extend above the box body from damage.

Conventional hinged lid boxes have a flat panel at the lower edge of the front panel that is folded 180 degrees and secured to the inside surface of the lid front panel. This flap extends substantially the width of the lid front panel and is typically less than one half of the height of the lid front panel. The flap increases the rigidity of the lid front panel and provides a smooth, non-cut lower edge.

Hinged top boxes include ones with right angle corners and ones with rounded corners. It is important for each style of box to maintain the box lid closed so that the box will not open inadvertently and spill its contents, for example, smoking articles or loose particles of smoking material such as tobacco. The box lid closure should also be aesthetically pleasing to enhance the general appearance and consumer acceptance of the box.

A known technique for maintaining right angle corner boxes closed includes providing the innerframe with u-shaped slits or retention cuts at the innerframe corners so that when the innerframe is folded, retention cuts extend outwardly from each corner in the plane of the innerframe front panel. Thus, when the lid is closed, the retention cuts engage the interior side panels of the rectangular lid, pressing the lid sides apart and holding the lid tightly against the innerframe.

U.S. Pat. No. 4,753,383 refers to applying the innerframe corner tab technique to boxes having rounded corners. However, the tabs formed on the innerframe corners do not engage adequately the lid corners to press the lid sides apart or to hold the lid closed. Rather, the tabs are either sheared off or damaged by the bottom edge of the lid as the lid is closed, or urged to follow the curvature of the corners by the forces acting on the tabs from the lid corners and thus pushed back into the slits from which the tabs were cut. The result in either case is that forces exerted between the lid and the innerframe are insufficient to hold the lid sufficiently closed, notwithstanding that the lid may be mostly closed. The partial opening is unacceptable in a commercial product because it permits inadvertent opening of the box, leakage of the contents, and, in particular, results in a package that is unattractive and unacceptable to the consumer.

U.S. Pat. No. 4,753,383 also refers to maintaining a lid closed by cutting the front panel of the innerframe to form an anchoring tab. The anchoring tab is folded back 180 degrees onto the innerframe front panel so that the bottom edge of the anchoring tab will engage the top surface of a reinforcing strip that is secured to the inside surface of the lower edge of the lid front panel. When the lid is closed, the anchoring tab and the reinforcing strip are in end to end abutment in the same plane. This technique has not appeared in any commercial product. It is believed to be impractical due to the close tolerances required and the difficulty of maintaining the end to end abutment following repeated disengagement of the anchoring tab and the lid and the undesirable presence of the anchoring tab on the innerframe.

Accordingly, there is a continuing need for apparatus and methods for closing box lids for rounded corner hinged lid boxes that are easy to manufacture, aesthetically suitable, and maintain the box fully closed even after repeated use.

SUMMARY OF THE INVENTION

It is an object of this invention to provide an improved closure mechanism for maintaining the lid of a box securely closed.

It is another object of this invention to provide a method and apparatus for securing closed the box lid without damaging other components of the box or the contents of the box during repeated opening and closing of the box during its commercial life.

It is another object of this invention to increase the frictional forces holding the box lid closed without damaging the contents of the box and providing for easy opening and closure.

It is another object of this invention to provide a closure mechanism for closing a box lid that includes an innerframe having a smooth exterior surface.

In accordance with the invention, a rounded corner hinged lid box is provided having a second panel of material secured to the inside of the front panel of the lid such that the second panel extends substantially the width of the flat front portion of the box and extends substantially the height of the box lid front panel. Broadly, the invention provides for an increased thickened surface area at the upper inside portion of the lid front panel that engages a corresponding surface area at the innerframe front upon reclosing. The second panel of material provides structural reinforcement of the lid front panel, increases the mass of the lid and thus increases the frictional forces holding the lid and innerframe surfaces together, thereby improving reclosure of the lid. More particularly, the invention results in frictional forces between the innerframe front panel and the reinforced lid sufficient to hold the lid closed without relying on frictional forces between innerframe corner tabs and lid side walls or anchoring tabs extending from the innerframe. The second panel of material is preferably made from the same material as the lid front panel and more preferably is an integral panel contiguous with the front panel that is folded 180 degrees onto and secured to the inside of the lid front panel.

In a preferred embodiment, the second panel of material includes a pair of tabs that extend into the rounded corners of the lid adjacent the flat front panel of the lid. The panel tabs are interposed and pressed between the rounded corners of the lid and the corresponding rounded corners of the innerframe when the lid is closed. The panel tabs provide an additional thickened surface area between the lid and innerframe corners and, hence, a larger mass and frictional surface area for retaining the lid on the innerframe in the closed condition. Preferably, the panel tabs are not secured to the inside corners of the lid and are made of the same hard paperboard material as the second panel of material so that, when the lid is closed, the resilience of the panel tab material also may provide a spring force mass between the lid and the innerframe that further increases the frictional forces holding the lid more fully closed. The tabs also may extend along most or all of the side edge of the second panel, thereby filling most of the space between the opposing corners. The edge of the tabs adjacent the box body may have a contoured surface corresponding to the bottom edge of the lid so that the tabs do not protrude from the bottom edge of the lid.

Further, the second panel and panel tabs are preferably provided with the same thickness as the remainder of the box walls. Thus, when the box is assembled, the panel tabs will conform to the box corners and will not protrude beyond the surface of the pair of dust tabs that are used to secure the sides of the lid to the top of the lid or otherwise distort the rounded corner rectangular box configuration, as described more fully below.

In one embodiment, the rounded corners of the box lid, body, and innerframe include a plurality of score lines spaced substantially equidistant to obtain corners with a relatively uniform radius, and the panel tabs are provided with one or more score lines so that the panel tabs will deform to follow generally the curvature of the corners when the lid is closed. In a preferred embodiment, the score lines in each panel tab are fewer in number and spaced further apart than the score lines in the box corners. Repeated closure of the lid will cause both the innerframe corners and the lid corners to contact and deform the panel tabs about their score lines, thereby enhancing the retentive effect of the second panel of material.

Advantageously, the box is formed from a single blank having suitable slits and score lines for erecting the hinged lid box into a rounded corner shape. The second panel of material, preferably with laterally extending tabs, may be formed integral with the single blank as an extension to the lid front panel. In this preferred embodiment, a score line could be used to define the lid front panel and the second panel of material, whereby the second panel may be folded along the score line 180 degrees back onto the inside of lid front panel during erection of the box. Preferably, the height dimension of the second panel is such that upon 180° folding, it is superposed over an upper inside portion of the front lid panel. Preferably, the second panel is greater than 50% of the height of the lid front panel, more preferably from 75% to about 95% to permit some tolerance for assembly and increased front panel surface area. The second panel could extend beyond the first panel to lie partially beneath the lid top.

BRIEF DESCRIPTION OF THE DRAWINGS

The above and other objects and advantages of the invention will be apparent upon consideration of the following detailed description, taken in consideration with the accompanying drawings, in which like reference characters refer to like parts throughout, and in which:

FIG. 1 is an elevational perspective view of a rounded corner box in accordance with an embodiment of the present invention;

FIG. 2 is an elevational perspective view of the box of FIG. 1 in an open position;

FIG. 3 is a front elevational view of the box lid of FIG. 2;

FIG. 4 is a side elevational view of the box of FIG. 2;

FIG. 5 is a plan view of a one-piece blank for the box of FIG. 1;

DETAILED DESCRIPTION OF THE INVENTION

Figure 6:
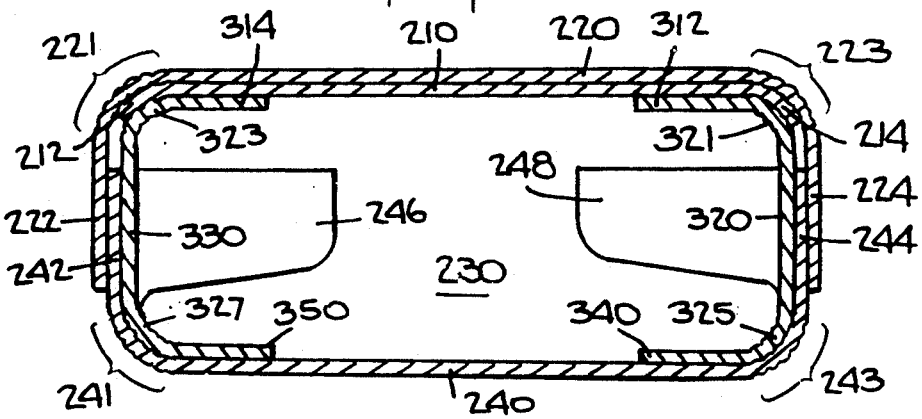
FIG. 6 is a sectional view taken along line 6—6 of FIG. 1.

As shown in FIGS. 1-8, a hinged lid box 10 incorporating an illustrated embodiment of the present invention is shown. Box 10 includes a body 100 and a lid 200 hinged together at the rear of box 10, and an innerframe member 300 that is secured at the inside front of body 100 and extending out of body 100. Box 10 has in its closed condition a generally rectangular configuration comprising a plurality of flat panels including a top panel 230, a bottom panel 130, a front surface comprising a front body panel 120 and a front lid panel 220, a rear surface comprising a rear body panel 140 and a rear lid panel 240, a left side surface comprising a side body panel 142 and an inside side lid panel 242, and a right side surface comprising a side body panel 144 and an inside side lid panel 244. Top panel 230 and bottom panel 130 are substantially parallel when box 10 is closed and at an angle to each other when box 10 is open.

The flat panel surfaces are connected by rounded corners such that, for body 100, front panel 120 is connected to left front side panel 122 by corner radius area 121, left front side panel 122 is secured in superposition to and outside of left rear side panel 142, panel 142 is in turn is connected to rear panel 140 by corner area 141, rear panel 140 is connected to right rear side panel 144 by corner radius area 143, right rear side panel 144 is secured in superposition to and inside of right front side panel 124, and panel 124 is in turn connected to front panel 120 by corner radius area 123.

Similarly, for lid 200, front panel 220 is connected to left front side panel 222 by corner radius area 221, left front side panel 222 is secured in superposition to and outside of left rear side panel 242, panel 242 is in turn connected to rear panel 240 by corner area 241, rear panel 240 is connected to right rear side panel 244 by corner radius area 243, right rear side panel 244 is secured in superposition to and inside of right front side panel 224, and panel 224 is in turn connected to front panel 220 by corner radius area 223.

In assembling box 10 from the blank shown in FIG. 5, body tabs 146 and 148 are respectively secured to the interior of bottom panel 130, and body side panels 142 and 144 are respectively secured in superposition to and inside of side panels 122 and 124, thereby forming a stable box body which have four rounded corners, parallel front and rear panels, parallel side panels, and a square rounded corner bottom configuration that will stand on its bottom panel. Bottom panel 130 is in a plane that is perpendicular to bottom front panel 120, side panels 122 and 124 and rear panel 140.

Similarly, lid tabs 246 and 248 are secured to the interior of lid panel 230 and lid side panels 242 and 244 are respectively secured in superposition to and inside of lid panels 222 and 224 to provide a lid having corners, front, rear and side panels that are in alignment with and parallel to the corresponding body corners and panels. Top panel 230 is in a plane that is perpendicular to lid front panel 220, rear panel 240, side panels 222 and 224, and corner radius areas 221, 223, 241, and 243.

The blank is provided with score lines for bending the panels into the erected box configuration. Score lines 131 and 132 provide for respectively bending body front panel 120 and rear panel 140 ninety degrees relative to bottom 130, and score lines 133 and 134 provide for respectively bending tabs 146 and 148 ninety degrees so that they can be affixed to bottom 130. Similarly, score lines 231 and 232 provide for respectively bending lid front panel 220 and rear panel 240 ninety degrees relative to top panel 230, and score lines 233 and 234 provide for respectively bending tabs 246 and 248 ninety degrees so that they can be affixed to top panel 230.

Box 10 also is provided with an articulated hinge comprising score line 235 and slits 236 and 237. Slits 236 and 237 are mirror images of each other having a long slit in the area that forms the side panels and corners and a short slit in the area that forms the box rear. The long slits are made at an angle to the edge of the package blank which provide an angled edge or miter between the lid and body, preferably at an angle of 34.5 degrees. The short slits are interior to corner areas 241 and 243 and below score line 235, and preferably are at a mirror image angle that is the same angle as the miter of the long slits. The long slits also may include cutting a notch or removing a small area of the blank, preferably in the form of an acute isosceles triangle so that the outward edges of panels 242 and 244 and panels 142 and 144 are further apart at the edge of the blank than at the border of those side panels and their adjacent corner areas. The notches provide for panels 242, 244, 142 and 144 not interfering with the formation of a smooth miter edge when those panels are secured inside of their respective outer panels 222, 224, 122 and 124.

Each of front corner radius areas 121, 123, 141, and 143 and rear corner radius areas 221, 223, 241, and 243 have a plurality of parallel score lines, preferably seven lines scored on the outer surface of the box, for providing box 10 with rounded corners. Preferably, the score lines are equidistant and provide a uniform radius.

Box 10 also includes innerframe 300 which is secured to the interior of body 100 with innerframe front panel 310 having a lower portion secured in superposition to front body panel 120, innerframe side panel 320 secured in superposition to body side panel 244, and innerframe side panel 330 secured in superposition to body side panel 242. Front panel 310 also has an upper portion including front surfaces 312 and 314 which extend from above body 100 to the top of innerframe 300 and straddle a cut-out region. The cut-out region provides for easy removal of the product.

Innerframe 300 also has corner areas 321 and 323 which contain a plurality of score lines having a size and spacing selected so that the corner areas are provided with a radius that will nest closely with corresponding corner radius areas 221 and 223 of lid 200 and corner areas 121 and 123 of body 100. Innerframe 300 thus provides protection to the product when box 10 is open and provides a surface for frictionally receiving lid 200 in the closed position.

Innerframe 300 is substantially parallel to the surfaces of box 10. It is secured at a position whereby the top of innerframe 300 is close to the inside of lid 200, almost flush with the underside of top panel 230. Thus, in the closed position, lid front panel 220 and body front panel 120 are flush, preferably in the same plane. When the innerframes are formed from blanks, the cutout region of one blank is a panel extension in the lower portion of the front panel of the adjacent innerframe blank and the extension assists in the positioning of the innerframe in the body.

In accordance with one embodiment of box 10, innerframe 300 also includes rear corner areas 325 and 327 which nest in corresponding lid rear corners 243 and 241 and body rear corners 141 and 143. In addition, innerframe 300 may include rear panels 340 and 350 which are secured to rear body pack panel 140 and fit against lid rear panel 240. The innerframe may be constructed, however, without the rear panels 340 and 350.

Box 10 is used to contain products, and is particularly useful for containing a plurality of smoking articles, e.g., 20 cigarettes (not shown) wrapped in a foil liner 20. In this embodiment, the radius of the corners of box 10 and interframe 300 are approximately the same as the radius of one smoking article, thereby providing a tight pack of the articles prior to the first opening of box 10. It is to be understood, however, that the precise dimensions and number of various flat panels and corner radius area score lines may be adjusted to obtain a package of a desired size for containing one or a plurality of desired products of a particular size. For example, if the box is used to contain relatively thin cigarettes, then corners may be provided with a smaller radius corresponding to the cigarette dimensions, and smaller body panels may be used.

Box 10 also may contain appropriate product labeling on its outer surfaces, for example, on one or more of the flat body pack and lid panels.

In accordance with the present invention, lid 200 includes a 180 degree fold panel 210 having approximately the same dimensions as lid front panel 220 and is secured in superposition to the inside of front lid panel 220. The panels are preferably glued together. Thus, when lid 200 is closed, panel 210 is interposed between panel 220 and the upper portion of innerframe panel 310, including portions 312 and 314, so that it does not interfere with closing (or opening) box 10 or damage the product or innerframe 300. The dimensions of 180 degree fold panel 210 and innerframe panel 310 (including upper portions 312 and 314) are such that there is a close fit, preferably contiguous, thereby producing frictional forces that are sufficient to retain lid 200 in the fully closed position.

The retaining action between frontal surfaces of box 10 the upper inside surfaces of the lid obviates the need for horizontal innerframe corner retention tabs of the prior art. The arrangement facilitates a smooth and full closing action with the lid.

Figure 8:
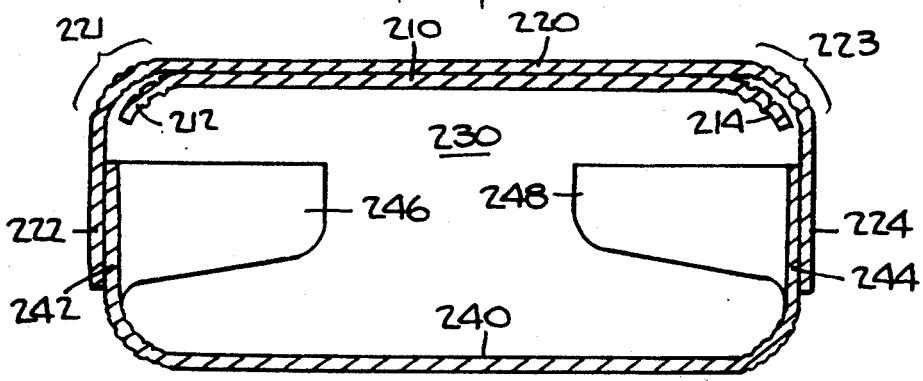
FIG. 8 is a sectional view taken along line 8—8 of FIG. 3.
Figure 7:
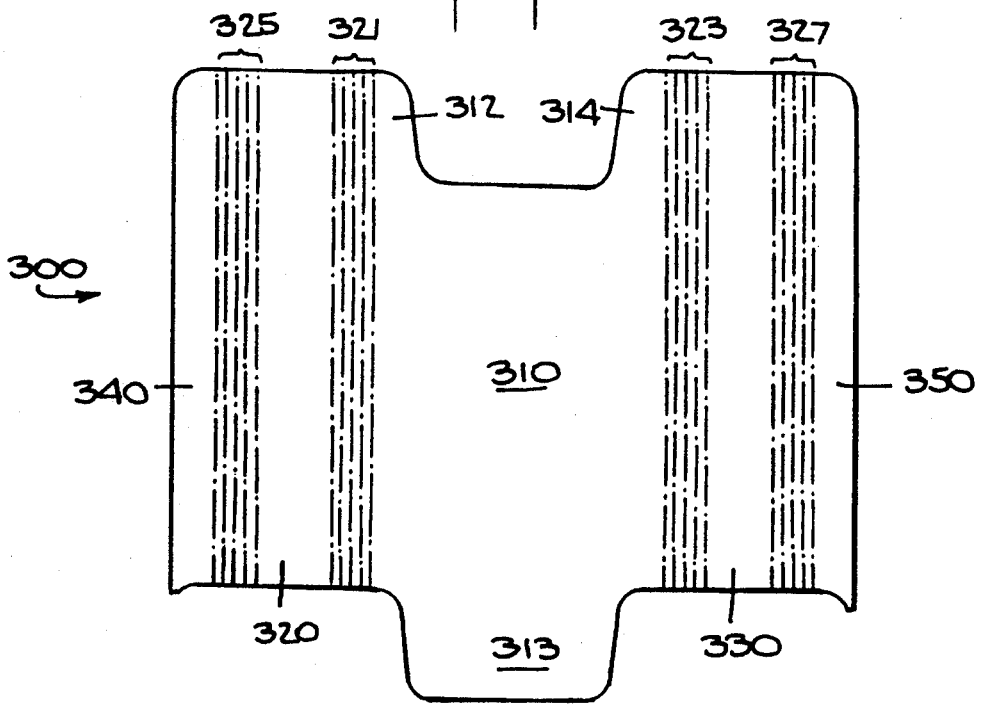
FIG. 7 is a plan view of a one-piece blank for an innerframe of FIG. 2.
Figure 9:
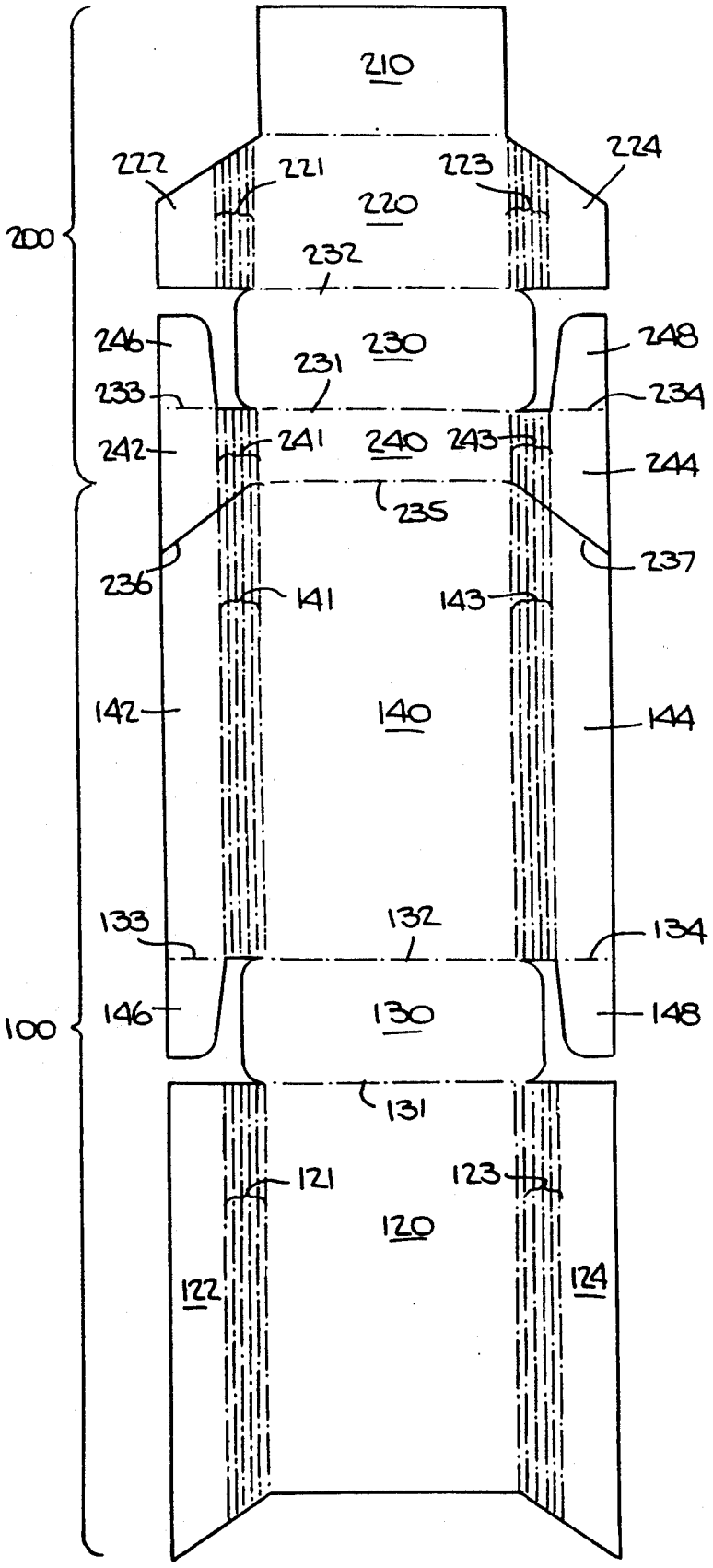
FIG. 9 is a plan view of another one-piece blank that embodies the present invention.

In another preferred embodiment, panel 210 also includes panel tabs 212 and 214 which extend into lid corners 221 and 223 as shown in FIG. 8. Panel tabs 212 and 214 are urged against the lid corner surfaces by innerframe corners 323 and 321 when lid 200 is closed as shown in FIG. 6. Tabs 212 and 214 preferably are not secured to lid 200 so that during closure, tabs 212 and 214 are able to move relative to lid 200 and so that when lid 200 is open, tabs 212 and 214 may extend away from the inner surface of lid corners 221 and 223.

Tabs 212 and 214 are typically made of the same hard paperboard as box 10 and have a resistance to bending. This resistance may be utilized to increase the forces between lid corners 221 and 223 and innerframe corners 323 and 321 to enhance the ability of the 180 degree fold panel 210 to maintain lid 200 closed.

In a preferred embodiment, tabs 212 and 214 are provided with respective pluralities of score lines 215 and 216 that reduce the force needed to cause tabs 212 and 214 to bend and conform to the corners of box 10, but do not degrade significantly the ability of the tabs to maintain the lid closed during repeated operation for the commercial life of the box. The number of score lines is preferably fewer than the number of score lines in the corresponding corner areas so that the tab will be relatively more rigid than the corner surfaces in which they will be in contact, but not so rigid that it will distort the desired radius of the corner. Tab score lines 215 and 216 may be continuously embossed score lines, intermittently embossed score lines or a plurality of perforations.

Although described in connection with a rounded corner box, it is believed that the invention also is useful in boxes having right angle corners. One skilled in the art will appreciate that the present invention can be practiced by other than the described embodiments, which are presented for purposes of illustration and not of limitation, and the present invention is limited only by the claims which follow.

I claim:

1. A rounded corner hinged lid box having an open position and a closed position, comprising:

a lid having a first front panel having a first height and a first width and a first and second sides, a second front panel having a second height and a second width, the second width being approximately the same as the first width and the second height being greater than 50% of the first height, the second front panel being secured in superposition to the first front panel and further comprising a first tab and a second tab, the first tab extending from one side of the lid second front panel and the second tab extending from the other side of the lid second front panel so that the tabs are respectively in superposition to the first and second rounded corners of the lid;

a rear panel, a first rounded corner at one of the first or second sides of the first front panel, and a second rounded corner at the other of the first or second sides of the first front panel;

a body having a bottom panel, a front panel having a third height and a third width and a first and second sides, the third width being approximately the same as the first width, a rear panel, a first rounded corner at one of the first or second sides of the front panel;

a second rounded corner at the other of the first or second sides of the front panel;

a hinge for connecting the lid rear panel to the body rear panel so that the body front panel and its first and second corners are respectively aligned with the first lid front panel and its first and second corners;

an innerframe having a front panel having an upper portion and a first and second sides, a first rounded corner at one of the first or second sides of the front panel, and a second rounded corner at the other of the first or second sides of the front panel; and means for securing the innerframe in superposition to and alignment with a portion of the body front panel and its first and second corners so that the upper portion of the innerframe front panel and its first and second rounded corners extend above the body front panel and its first and second rounded corners, whereby the tabs are in frictional contact with the first and second rounded corners of the lid and the first and second rounded corners of the innerframe when the lid is closed.

2. The hinged lid box of claim 1 wherein the second height is between from about 75% to about 95% of the first height.

3. The hinged lid box of claim 1 wherein each of the first and second tabs further comprises one or more score lines.

4. The hinged lid box of claim 3 wherein the first and second rounded corners of the lid and body each further comprises a second plurality of parallel score lines, and the first and second corners of the innerframe each further comprises a third plurality of score lines, the number of score lines in the second and third pluralities each being greater than the number of score lines in each of the first and second tabs, and the distance between score lines in each of the second and third pluralities being less than the distance between the score lines in each of the first and second tabs.

5. The hinged lid box of claim 1 wherein the lid is formed from a blank having the first front panel and the second front panel contiguous and separated by a score line, the second panel being folded 180 degrees about the score line to form the superimposed first and second front panels.

6. In a rounded corner box having a lid and a body hinged together with an open position and a closed position and an innerframe secured in the body and extending into the lid, a system for maintaining the lid in the closed position comprising:

an innerframe front panel extending above the box body having on either side first and second rounded corners extending above the body;

a first lid front panel having a first height and first width, the first width being the distance between the first and second rounded corners on either side of the front lid panel, the first and second front lid corners corresponding to the first and second innerframe corners;

a second lid front panel superposed along an upper side portion of the first front lid panel, the second lid front panel comprising a first tab and a second tab, the first tab extending into one corner of the lid and the second tab extending into the other corner of the lid, whereby in the closed position the first tab conforms in frictional contact with the one corner of the lid and the corresponding one corner of the innerframe and the second tab conforms in frictional contact with the other corner of the lid and corresponding other corner of the innerframe.

7. The system of claim 6 wherein the second lid front panel has a second height and a second width, the second height being greater than 50% of the first height, the second width being approximately the same as the first width, the second lid front panel being secured in superposition to and alignment with the first lid front panel.

8. The system of the claim 7 wherein the second height is between from about 75% to about 95% of the first height.

9. The system of claim 6 wherein each of the first and second tabs further comprises one or more score lines.

10. The system of claim 9 wherein each of the first and second rounded corners of the lid and body further comprises a second plurality of parallel score lines and each of the first and second rounded corners of the innerframe further comprises a third plurality of score lines, the number of score lines in each of the second and third pluralities being greater than the number of score lines in the first and second tabs, and the distance between the score lines in each of the second and third pluralities being less than the distance between the score lines in the first and second tabs.

11. The system of claim 6 wherein the first lid front panel and the second lid front panel are a part of a single blank separated by a score line and the second lid front panel is folded 180 degrees about the score line to form the superimposed first and second lid front panels.

12. A hinged lid box having an open position and a closed position, comprising:

a lid having a first front panel having a first height, a first width, and a first and second sides, a second front panel having a second height and a second width, the second width being approximately the same as the first width and the second height being greater than 50% of the first height, the second front panel being secured in superposition to the first front panel and further comprising a first tab and a second tab, the first tab extending from one side of the lid second front panel and the second tab extending from the other side of the lid second front panel so that the tabs are respectively in superposition to the first and second corners of the lid;

a rear panel, a first corner at one of the first or second sides of the first front panel, and a second corner at the other of the first or second sides of the first front panel;

a body having a bottom panel, a front panel having a third height and a third width and a first and second sides, the third width being approximately the same as the first width, a rear panel, a first corner at one of the first or second sides of the front panel, and a second corner at the other of the first or second sides of the front panel;

a hinge for connecting the lid rear panel to the body rear panel so that the body front panel and its first and second corners are respectively aligned with the first lid front panel and its first and second corners;

an innerframe having a front panel having an upper portion and a first and second sides, a first corner at one of the first or second sides of the front panel, and a second corner at the other of the first or second sides of the front panel; and means for securing the innerframe in superposition to and alignment with a portion of the body front panel and its first and second corners so that the upper portion of the innerframe front panel and its first and second corners extends above the body front panel and its first and second corners, whereby the tabs are in frictional contact with the first and second corners of the lid and the first and second corners of the innerframe when the lid is closed.

13. The hinged lid box of claim 12 wherein the second height is between from about 75% to about 95% of the first height.

14. The hinged lid box of claim 12 wherein each of the first and second tabs further comprise one or more score lines.

15. The hinged lid box of claim 14 wherein the first and second corners of the lid and body each further comprises a second plurality of parallel score lines for forming a rounded corner, and the first and second corners of the innerframe further each comprises a third plurality of scorelines for forming a rounded corner, the number of score lines in the second and third pluralities each being greater than the number of score lines in each of the first and second tabs, and the distance between the score lines in each of the second and third pluralities being less than the distance between the score lines in each of the first and second tabs.

16. The hinged lid box of claim 12 wherein the lid is formed from a blank having the first front panel and the second front panel contiguous and separated by a score line, the second panel being folded 180 degrees about the score line to form the superimposed first and second front panels.

17. In a box having a lid and a body hinged together with an open position and a closed position and an innerframe secured in the body and extending into the lid, a system for maintaining the lid in the closed position comprising:

an innerframe front panel extending above the box body on either side having first and second corners extending above the body;

a first lid front panel having a first height and a first width, the first width being the distance between the first and second corners on either side of the first lid front panel, the first and second corners corresponding to the first and second innerframe corners;

a second front lid panel comprising a first tab at its one side and a second tab at its other side, the first tab extending around one corner of the lid and the second tab extending around the other corner of the lid, whereby in the closed position the first tab conforms in frictional contact with the one corner of the lid and the corresponding one corner of the innerframe and the second tab conforms in frictional contact with the other corner of the lid and the corresponding other corner of the innerframe, the second front lid panel being superposed along an upper inside portion of said first front lid panel having a second height and a second width, the second height being greater than 50% of the first height, the second width being approximately the same as the first width, the second lid front panel being secured in superposition to and alignment with the first lid front panel so that, in the closed position, the second front panel is in frictional contact with the innerframe front panel to retain the lid closed.

18. The device of claim 17 wherein the second height is between from about 75% to about 95% of the first height.

19. The system of claim 17 wherein each of the first and second tabs further comprises one or more score lines.

20. The system of claim 19 wherein each of the first and second corners of the lid and body further comprise a second plurality of parallel score lines for forming a rounded corner and each of the first and second corners of the innerframe further comprise a third plurality of score lines for forming a rounded corner, the number of score lines in each of the second and third pluralities being greater than the number of score lines in each of the first and second tabs, and the distance between the score lines in each of the second and third pluralities being less than the distance between the score lines in each of the first and second tabs.

21. The system of claim 17 wherein the first lid front panel and the second lid front panel are a part of a single blank separated by a score line and the second lid front panel is folded 180 degrees about the score line to form the superimposed first and second lid front panels.

22. A rounded corner box, comprising:

a rounded corner body, a rounded corner lid comprising a first front lid panel and a second front lid panel, the second front lid panel further comprising a first tab and a second tab, the first tab extending from one side of the second front lid panel and the second tab extending from the other side of the second front lid panel so that the tabs are in superposition to the rounded corners of the lid, a hinge operative between the lid and the body so that upon closing the lid is superposed over an upper front portion of the body, the lid further comprising sufficient thickness at the second front lid panel so that upon reclosing the second front lid panel slidably engages the upper front portion of the body and the tabs slidably engage the rounded corners of the body.

23. A method of retaining a lid of a rounded hinge lid box in a closed position, whereupon the lid comprising a first front panel and a second front panel, the second front panel further comprising a first tab and a second tab, the first tab extending from one side of the second front lid panel and the second tab extending from the other side of the second front lid panel so that the tabs are in superposition to the rounded corners of the lid when the lid is open, is superposed over an upper front portion of the box, the method comprising the steps of the slidingly engaging the second front lid panel with the upper front portion of the box upon fully reclosing the lid.

* * * * *